US006073420A

United States Patent [19]

Bjøru et al.

[11] Patent Number: 6,073,420

[45] Date of Patent: Jun. 13, 2000

[54] PLATE WEB AND PROFILE ELEMENT

[75] Inventors: Ørjan Bjøru, Gruben; Gunnar Øvringmo, Båsmoen; Rune Jandinger, Oslo, all of Norway

[73] Assignee: Fundia Profiler A/S, Mo, Norway

[21] Appl. No.: 08/894,991

[22] PCT Filed: Feb. 13, 1996

[86] PCT No.: PCT/NO96/00033

§ 371 Date: Oct. 27, 1997

§ 102(e) Date: Oct. 27, 1997

[87] PCT Pub. No.: WO96/25323

PCT Pub. Date: Aug. 22, 1996

[30] Foreign Application Priority Data

Feb. 16, 1995 [NO] Norway ..... 950577
Apr. 5, 1995 [NO] Norway ..... 951324

[51] Int. Cl.[7] ..... E04C 2/32

[52] U.S. Cl. ..... 52/800.1; 114/79 R; 52/729.1; 52/729.2

[58] Field of Search ..... 52/800.1, 720.1, 52/729.1, 729.2, 731.1, 737.2; 114/79 R, 79 W, 79 A, 342; 428/598, 603

[56] References Cited

U.S. PATENT DOCUMENTS 1,328,841 1/1920 Little .
1,367,942 2/1921 Boyle et al. .
1,821,882 9/1931 Curr .
2,201,047 5/1940 Moore et al. .
2,263,272 11/1941 Moss ..... 114/74 A
5,375,547 12/1994 Abe et al. ..... 114/74 A
5,379,711 1/1995 Fischer et al. .
5,477,797 12/1995 Stuart ..... 114/54 R
5,581,969 12/1996 Kelleher ..... 52/602
5,600,932 2/1997 Paik ..... 52/745.19

FOREIGN PATENT DOCUMENTS

WO94/22632 10/1994 WIPO .

*Primary Examiner*—Beth A. Aubrey
*Attorney, Agent, or Firm*—Rodman & Rodman

[57] ABSTRACT

The plate web and profile element include a web frame with a plate welded at a side edge to a flange. The flange is in the form of a bulb body. The bulb body can project symmetrically or asymmetrically relative to a mid-plane of the plate. The bulb body, in cross section, includes a plane welding face welded to the side edge of the plate and a common face that is spaced and parallel to the plane welding face. The bulb body in cross section also includes inclined faces extending from the plane welding face at an obtuse angle ($\alpha$) of approximately 100° to 120° with the side surfaces of the plate. The bulb body further includes opposite side edges that are parallel to the opposite side surfaces of the plate and intersect the common face and the inclined faces of the bulb body. Rounded corners are provided at the intersection of the side edges of the bulb body with the common face and the inclined faces.

19 Claims, 3 Drawing Sheets

PLATE WEB AND PROFILE ELEMENT

SUMMARY OF THE INVENTION

The invention relates to a web frame in the form of a plate with a flange welded in place along one side edge thereof. The invention also relates to a profile body intended to be welded at right angles onto on a web-forming plate as a flange projecting symmetrically or asymmetrically from both sides of the plate.

The invention has been developed in connection with the design and construction of fair-sized ships, but the new web frame and profile body according to the invention could, of course, also be used to advantage in other installations where there is a need for the use of frames or frame-like braces.

As ship dimensions have increased, the shipbuilding industry has seen a development of frames, including longitudinal frames, transverse frames and other similar braces, from rolled profiles to welded profiles. The last-mentioned profiles are supplied and used in the form of plates onto which flanges are welded along one side edge thereof, as is known from the typical T profiles or frames.

The flange terminations on the web frame are important with a view to obtaining the desired satisfactory strength for the web frame and the structure in general wherever the web frame is used. In addition to the requirement of sufficient strength, it is also a major factor that large, strong flanges increase the weight of the structure and also have a surprising, but considerable influence on the surface of the steel. The surface area in a structure, primarily a ship, is of great significance in terms of sheer costs because it involves surfaces which have to be treated with a view to corrosion protection. Moreover, today's usual welded web frames do not have an especially favourable structural design from a surface treatment point of view, primarily because in this case the web frames have rather inaccessible 90° internal corners, and also sharp external corners.

SE 9301013 makes known a web frame having a bulb-shaped flange welded onto the end face of a plate. The bulb projects from one of the sides of the plate only, thereby giving the web frame an L shape. This shape has not proven to be particularly favourable. It is very vulnerable to fatigue. The stress concentration factor (K) for an L profile of this kind will be about 2.5. In order to compensate for this, the dimensions, and hence the weight, must be increased. In the case of a traditional T-shaped web frame where both the web and the flange consist of flat bar steel, K will be about 1.5.

However, a flat bar steel web frame of this kind has poor properties with respect to corrosion resistance and accessibility for surface treatment as mentioned above.

It is an objective of the invention to provide web frames and profile bodies which will yield advantages with respect to weight/strength ratio, and especially with respect to paint area/strength ratio. The term paint is used here to mean any kind of surface treatment whose objective is to provide protection against corrosion.

According to the invention, it has been found that relatively large savings can be made with the special design of the web frame flange, the aim of which is to optimise conditions with respect to weight and paint area. According to the invention, it has been found surprisingly that the aim of the invention can be reached by shaping the flange as a bulb body projecting symmetrically or asymmetrically relative to the mid-plane of the plate on both sides thereof, and that the bulb body in cross-section has inclined sides projecting at an obtuse angle ($\alpha$) of 100° to 120° which, via a respective edge side having rounded corners and formed parallel to the plate, passes into a common side extending at right angles to the web frame.

The term bulb or bulb body is used here to mean a thickened, rounded profile body, which is distinct from the usual flat and straight-edged flange embodiment, where the actual flange is in reality a plate member which is welded at right angles onto the plate in order to form a web frame. With this design it is possible to achieve a stress concentration factor which is as low as 1.5 to 1.9, whilst obtaining the above-mentioned favourable conditions with respect to corrosion resistance and surface treatment.

The moderate asymmetrical shape provides better buckling resistance compared with a symmetrical profile and a rather good anti-fatigue capacity. The asymmetric design is especially suitable for web frames of smallish dimensions as here there could otherwise be some torsional buckling. However, the asymmetry will be so small that the K factor will not rise significantly.

The preferred angle between the plate and the inclined side faces is 110°. In the case of the asymmetric profile, the angle of the smaller projecting bulb part may to advantage have the same value.

A symmetric or asymmetric bulb body as mentioned will yield surprising savings with respect to weight and paint area, compared with the known embodiments.

Thus, one of the objectives of the invention has been a favourable solution where an improved weight/strength ratio and a more favourable paint area/strength ratio are achieved than are known from earlier designs, a conscious effort having been made to provide a more rounded profile form (on the basis of the acknowledgement that the circular cylinder and the sphere are optimal embodiments with respect to surface area). With the new web frame, and in particular the special, new flange embodiment, improved physical conditions are obtained, a web frame being obtained having improved rounded corners, and with no sharp outer edges, i.e., areas that are rather inaccessible or are difficult to treat and coat properly with a suitable protective agent are avoided.

Another objective of the invention is to give the design engineer the possibility of favourable technical solutions on the basis of a small number of standardised elements, the design engineer being given the opportunity to dimension the web frames, and particularly the principal flanges according to need. According to the invention, a profile body is therefore also proposed that is designed to be welded at right angles onto the web-forming plate as a symmetric or asymmetric flange, which profile body is characterised in that in cross-section it is bulb-shaped, having a side with a central face for welding onto the plate, from which central welding face there inclines a respective falling side portion which, via respective parallel edge sides having rounded corners, passes into a side in opposite relation to the welding face and extending at right angles to the plate plane.

Thus, by means of the invention a profile body is provided which can be used for welding onto different plate widths for the formation of desired web frame dimensions (frame widths). The profile bodies can to advantage be dimensioned and shaped so that a design engineer could manage with a small number of such profile bodies, in that he could choose amongst these and specify a selected profile body for welding into place on a desired plate dimension.

The larger of the said side portions, or optionally both, can to advantage incline at an angle of 20° relative to a perpendicular on the plate plane.

Typical for a web frame or a profile body according to the invention is that the symmetric and asymmetric bulb body will have a considerably larger dimension in the frame plane than the actual thickness of the frame plane and the thickness of the commonly known plate-shaped flanges. As in the case of known web frames, the frame width will generally be at least one size larger than the thickness of the flange.

The invention will now be explained in more detail with reference to the drawings, wherein:

DETAILED DESCRIPTION OF THE INVENTION

Figure 1:
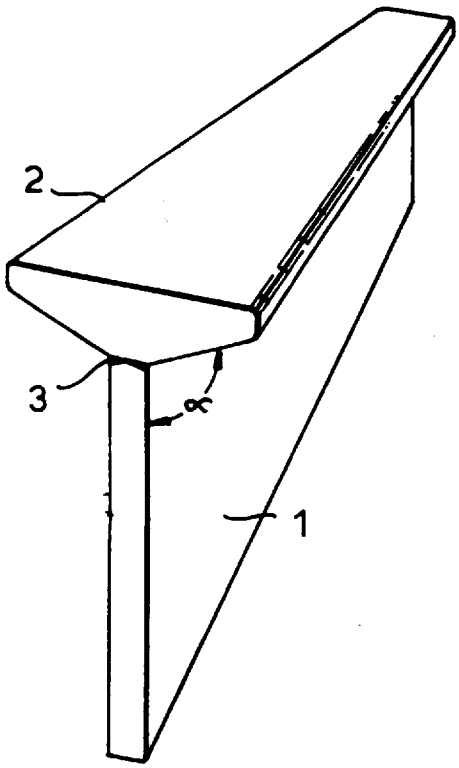
FIG. 1 is a perspective outline of a typical web frame according to the invention.
Figure 6:
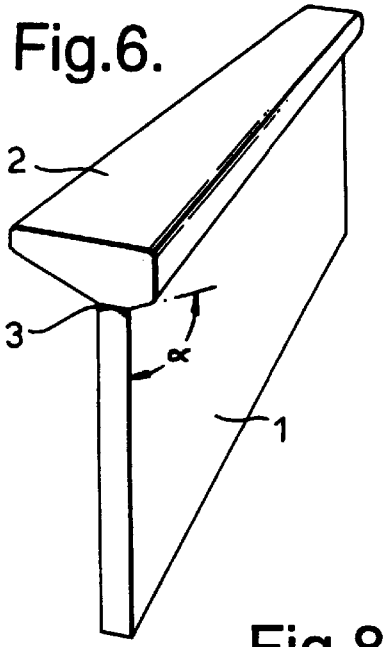
FIGS. 6–10 show the same as FIGS. 1–5 for an asymmetric cross-section.

FIGS. 1 and 6 are perspective outlines of a typical web frame according to the invention, built up of a plate 1 and a bulb-shaped profile body 2. The bulb-shaped profile body 2 forms a flange on the web frame, the plate 1 constituting the web plate in the web frame, and the two members are welded together at 3. As shown in the drawings 1,2 and 3,4, the profile body 2 is designed to have a central welding face 4, whence there inclines to both sides falling side portions or side faces 5,6 which, via side faces 9,10 having rounded corners 7,8, pass into a common side face 11, which is opposite the welding face 4.

One of or both of the two inclined side faces 5,6 incline (FIGS. 1 and 6) at an angle $\alpha$=110° relative to the plate plane. In other words: the inclined side face or faces 5,6 form an angle of 20° relative to a perpendicular on the plate plane.

Figure 2:
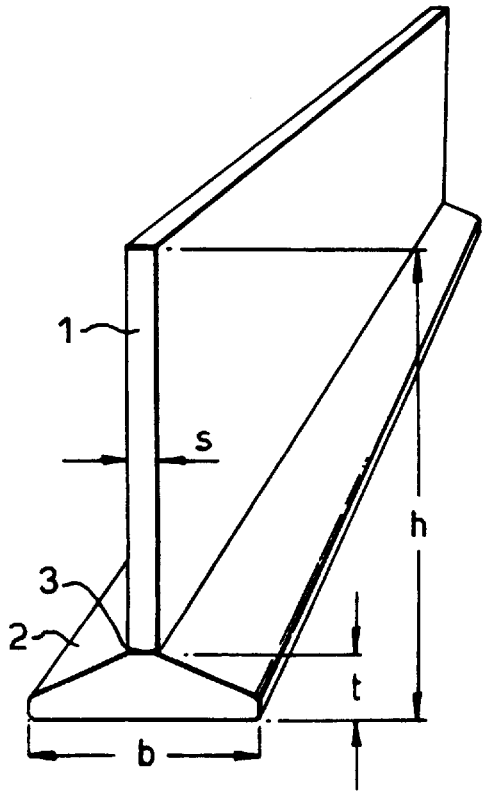
FIG. 2 is a perspective outline of the web frame in FIG. 1, seen from the welding side of the web frame.
Figure 3:
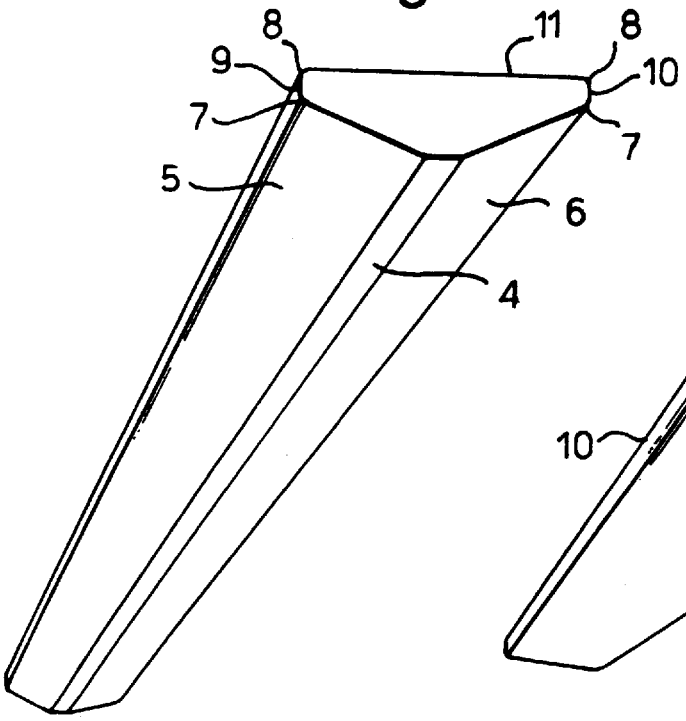
FIG. 3 is a perspective outline of a profile body according to the invention.
Figure 4:
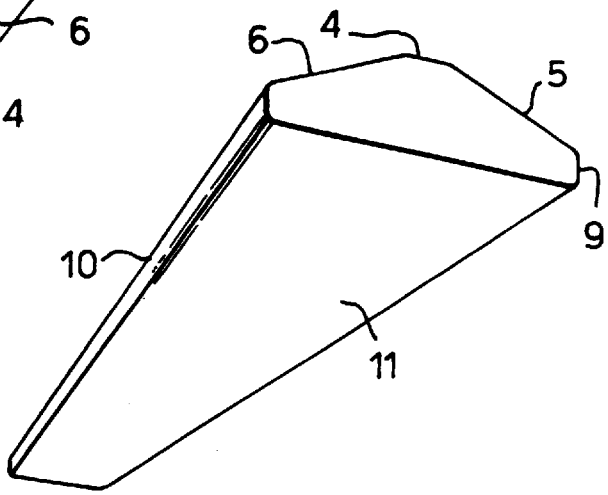
FIG. 4 shows the profile body in FIG. 3 seen from the outward facing side, i.e., the free or unattached side of the profile body when it is welded in place.
Figure 7:
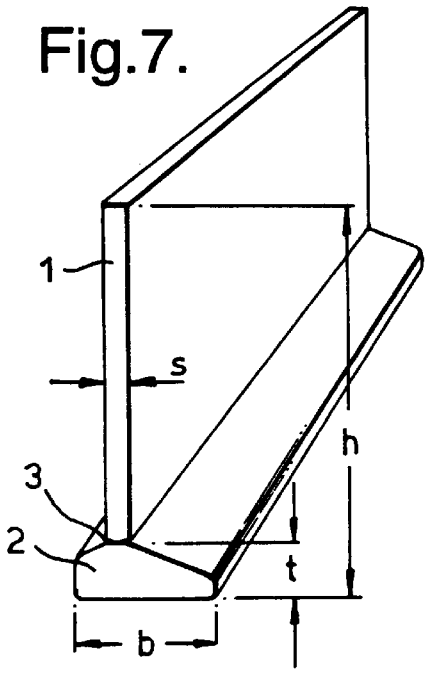
Figure 8:
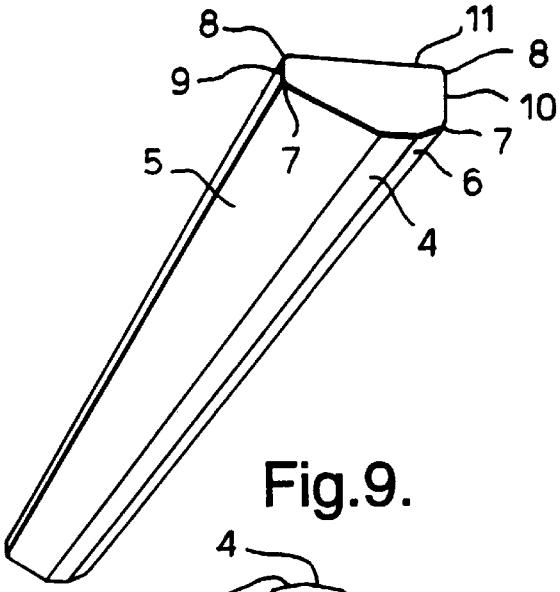
Figure 9:
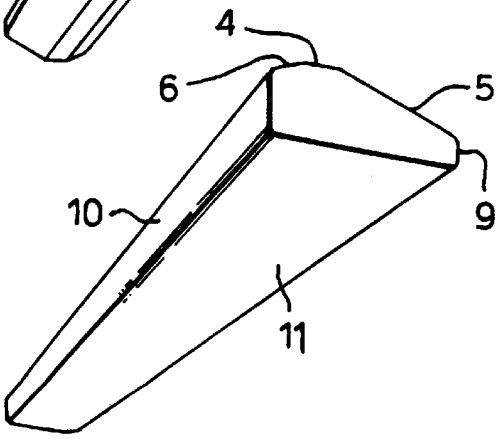

As shown in FIGS. 2 and 7, the web frame has a frame width h which is several times greater than the thickness t of the bulb body 2, preferably at least one size greater. Thus, for example, h in the case of a typical web frame may be 650 mm, whilst the thickness t of the bulb-shaped body 2 may be from 40 to 50 mm. A relevant thickness s for the actual plate 1 will, for example, be 12 mm. The width b of the flange may be from 125 to 200 mm. The width of the welding face 4 may be from 20 to 30 mm, preferably 25 mm, i.e., greater than the thickness s of the plate so that one and the same profile body can be used to build up a thicker web frame, $s \leqq 18$. With this design it is possible to use conventional welding lines.

Figure 5:
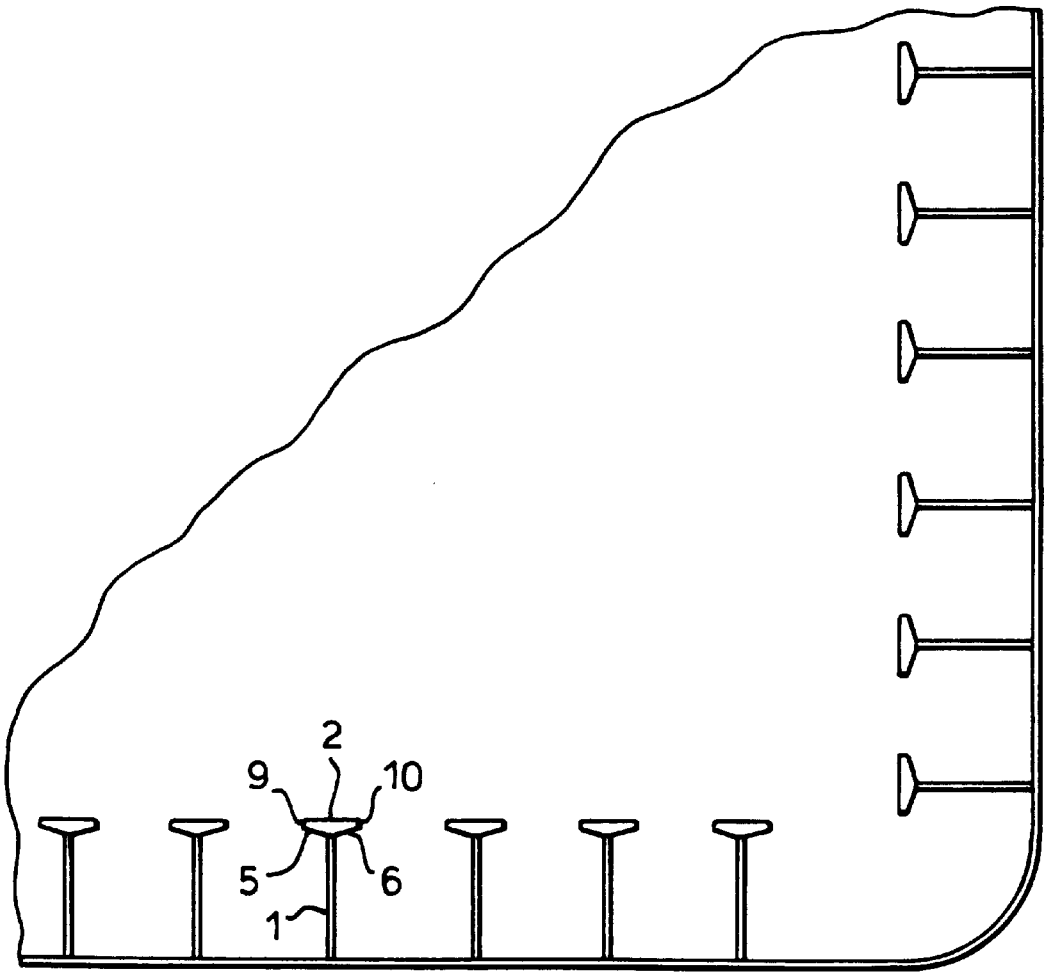
FIG. 5 shows an example of the application of the new web frame on board a ship.
Figure 10:
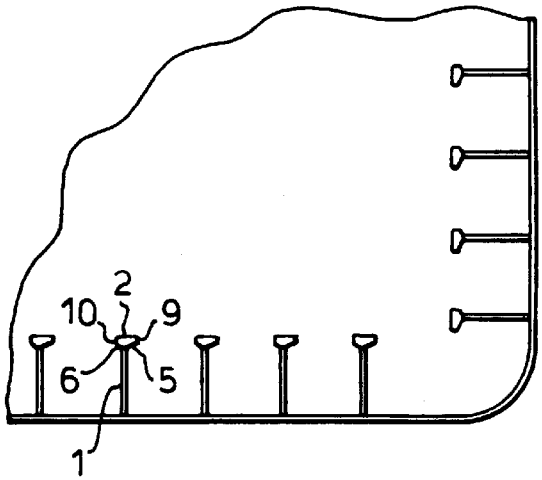

FIGS. 5 and 10 show an example of how the web frame according to the invention can be used on board a ship, in this case a tanker having a longitudinal frame. Here, it can be seen in particular that the bulb-shaped flange is very rounded so that rather inaccessible corners (internal corners) are avoided, which is a major advantage with respect to the anti-corrosion treatment which is necessary in structures of this type. As mentioned, it is a particular advantage of the invention that the areas on the back of the flanges are rounded in shape, to which the inclined rear side faces 5,6 and the rounded corners of the side edges 9,10 contribute.

What is claimed is:

1. A web frame comprising a web plate and a flange welded to each other, the web plate having opposite side walls and a welding edge extending across the opposite side walls, the flange being welded to the welding edge of the web plate and having a bulb body extending beyond the opposite side walls of the web plate, said bulb body, in cross section, having (i) a plane welding face portion welded to the welding edge of the web plate, (ii) a common face spaced from and parallel to the plane welding face portion, (iii) an inclined face extending away from each said opposite side wall and extending away from the plane welding face portion at an obtuse angle ($\alpha$) of approximately 100° to 120° to each said opposite side wall of the web plate, (iv) opposite side edges parallel to the opposite side walls of the web plate, each said opposite side edge extending across a respective said common face and a respective said inclined face such that each said opposite side edge intersects one of the common faces and one of the inclined faces, and (v) rounded corners at the intersection of the opposite side edges with the inclined faces and the common face.

2. The web frame as claimed in claim 1 wherein the plane welding face portion has a width of approximately 20 to 30 millimeters and said web plate has a thickness between the opposite side walls that is less than or equal to the width of said plane welding face portion.

3. The web frame as claimed in claim 1 wherein said plane welding face portion has a width of 25 millimeters.

4. The web frame as claimed in claim 1 wherein the obtuse angle ($\alpha$) is 110°.

5. The web frame as claimed in claim 1 wherein the distance between the opposite side edges of the bulb body is approximately 125 to 200 millimeters and the distance between the plane welding face portion and the common face is approximately 40 to 50 millimeters.

6. The web frame as claimed in claim 1 wherein the ratio of the distance between the opposite side edges of the bulb body and the distance between the plane welding face and the common face portion is between 2.5 and 4.5 respectively.

7. A profile body for welding onto a plate as a flange projecting symmetrically or asymmetrically from the plate, said profile body comprising a bulb shaped member, said bulb shaped member, in cross section, having, (i) a plane welding face for welding onto the plate, (ii) a common face spaced from and parallel to the plane welding face, (iii) a pair of inclined faces extending from said plane welding face and diverging from each other toward said common face, and inclined at an angle of approximately 10° to 30° with said common face, (iv) opposite side edges generally perpendicular to the common face and intersecting the common face and the inclined faces, and (v) rounded corners at the intersection of the opposite side edges with the inclined faces and the common face.

8. The profile body as claimed in claim 7 wherein the plane welding face has a width of approximately 20 to 30 millimeters, said width being selected to be broader than or equal to the thickness of the plate that is welded to the plane welding face.

9. The profile body as claimed in claim 7 wherein the plane welding face has a thickness of 25 millimeters.

10. The profile body as claimed in claim 7 wherein the angle of inclination of the inclined faces with said common face is 20°.

11. The profile body as claimed in claim 7 wherein the distance between the opposite side edges is approximately 125 to 200 millimeters and the distance between the plane welding face and the common welding face is approximately 40 to 50 millimeters.

12. The profile body as claimed in claim 7 wherein the ratio of the distance between the side edges and the distance between the plane welding face and the common face is between 2.5 and 4.5 respectively.

13. A profile body for welding onto a plate as a flange projecting symmetrically or asymmetrically from the plate, said profile body comprising a bulb shaped member, said bulb shaped member, in cross section, having, (i) a plane welding face for welding onto the plate, (ii) a common face spaced from and parallel to the plane welding face, (iii) a pair of inclined faces extending from said plane welding face and diverging from each other toward said common face, and inclined at an angle of approximately 10° to 30° with said common face, and (iv) opposite side edges intersecting the common face and the inclined faces.

14. The profile body as claimed in claim 13 wherein rounded corners are provided at the intersection of the opposite side edges with the inclined faces and the common face.

15. The profile body as claimed in claim 13 wherein the plane welding face has a width of approximately 20 to 30 millimeters, said width being broader than or equal to the thickness of the plate that is welded to the plane welding face.

16. The profile body as claimed in claim 13 wherein the plane welding face has a thickness of 25 millimeters.

17. The profile body as claimed in claim 13 wherein the angle of inclination of the inclined faces with said common face is 20°.

18. The profile body as claimed in claim 13 wherein the distance between the opposite side edges is approximately 125 to 200 millimeters and the distance between the plane welding face and the common welding face is approximately 40 to 50 millimeters.

19. The profile body as claimed in claim 13 wherein the ratio of the distance between the side edges and the distance between the plane welding face and the common face is between 2.5 and 4.5 respectively.

* * * * *